US006712152B1

(12) United States Patent
Yokley et al.

(10) Patent No.: US 6,712,152 B1
(45) Date of Patent: Mar. 30, 2004

(54) DOWNHOLE PLUG HOLDER AND METHOD

(75) Inventors: John M. Yokley, Kingwood, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 09/981,487

(22) Filed: Oct. 17, 2001

Related U.S. Application Data

(60) Provisional application No. 60/316,572, filed on Aug. 31, 2000.

(51) Int. Cl.[7] ..... E21B 33/16
(52) U.S. Cl. ..... 166/386; 166/155
(58) Field of Search ..... 166/152, 153, 166/155, 156, 291, 285, 381, 386

(56) References Cited

U.S. PATENT DOCUMENTS 4,624,312 A 11/1986 McMullin
4,671,358 A 6/1987 Lindsey, Jr. et al.
4,934,452 A 6/1990 Bradley
4,966,236 A * 10/1990 Braddick ..... 166/291
5,004,048 A * 4/1991 Bode ..... 166/70
5,036,922 A 8/1991 Braddick
5,890,537 A * 4/1999 Lavaure et al. ..... 166/285
6,311,775 B1 * 11/2001 Allamon et al. ..... 166/285
6,527,057 B2 * 3/2003 Fraser, III et al. ..... 166/386

FOREIGN PATENT DOCUMENTS

GB 2242459 A 11/1990
GB 2373800 A 3/2002

* cited by examiner

*Primary Examiner*—Frank Tsay
(74) *Attorney, Agent, or Firm*—Loren G. Helmreich; Browning Bushman, P.C.

(57) ABSTRACT

The plug holder sub 110 for being supported on a conveyance tubular temporarily supports a liner wiper plug 150, so that a pump down plug may land in the liner wiper plug and be supported from a generally tubular body 116 of the plug holder sub. The retaining member 114 is provided for attaching the liner wiper plug to the tubular body, and a piston 134 moves within the tubular body from a retaining position to a release position. A metering jet 130, 131 on a fluid flow path 128 from chamber 132 restrains the piston movement, thereby preventing release of the liner wiper plug until the piston moves to the release position.

26 Claims, 2 Drawing Sheets

DOWNHOLE PLUG HOLDER AND METHOD

RELATED CASE

The present application claims priority from Provisional Application No. 60/316,572 filed Aug. 31, 2000 entitled Liner Hanger Running Tool and Method.

FIELD OF THE INVENTION

The present invention relates to the plug holder of the type suitable for supporting a liner wiper plug and for thereafter releasing the liner wiper plug in response to increased fluid pressure. The plug holder sub of the present invention may be used in a cementing operation, with the liner wiper plug separating a cementations fluid from another fluid.

BACKGROUND OF THE INVENTION

Conventional liner hanger running tools include a plug holder sub adapted to support a liner wiper plug on the running tool during a cementing operation. The plug holder sub is conventionally latched to the running string, and the liner wiper plug is attached to the plug holder sub by a shear connection. Unfortunately, these shear connections frequently are prematurely weakened or are sheared either by running tool manipulation or by the momentum of the pump down plug landing and seating on the liner wiper plug.

Some manufacturers have included a plug holder sub that has a latching lug and a shifting sleeve. The plug cannot be released until the pump down plug shifts the sleeve to allow the latching lugs to relax and thereby allows the plug set to separate from the running tool. U.S. Pat. Nos. 4,624,312 and 4,934,452 disclose plug holder subs which use a collet instead of a latching lug. U.S. Pat. No. 5,036,922 discloses a running tool which employs a piston that is shifted in order for the plug set to be released.

While the above systems may prevent premature release of the plug set due to running tool movement or manipulation, they do not prevent premature release of the plug set due to the momentum of the pump down plug and the column of fluid behind that plug when it lands and seats on the liner wiper plug. In many applications, this landing or "hammering" force will cause the plug set to release so fast that the operator cannot detect the release and therefore cannot properly calculate the fluid displacements. This "hammering" effect of the pump down plug hitting the liner wiper plug and the effect of prematurely releasing the plug set may ruin a cementing job. The prior art has not addressed the problem of prematurely releasing the plug set due to this hammering effect of the pump down plug hitting the liner wiper plug. As a consequence, the operator may not be able to calculate the fluid displacement after the pump down plug has sealed and latched into the liner wiper plug.

The disadvantages of the prior art are overcome by the present invention, and an improved downhole plug holder and method for supporting a liner wiper plug are hereinafter disclosed which increase the reliability of cementing operations.

SUMMARY OF THE INVENTION

The plug holder sub of the present invention may be used for positioning a wiper plug which may be released from a line, hanger running tool or the end of a tubular string during a cementing operation. The plug holder sub may be releasably positioned on the lower end of the liner hanger running tool, and is sized to pass a pump down plug, which lands in the liner wiper plug supported on the running tool by the plug holder sub. The liner wiper plug is connected to the plug holder sub in a manner which prevents premature release of the plug set from the running tool, either upon manipulation of the running tool or due to the hammering effect of the pump down plug entering and latching into the liner wiper plug. Once the pump down plug is sealingly seated and latched within the bore of the liner wiper plug, fluid pressure acts on a piston which is moved to unlock the plug set from the running tool so that the plug set is released and allowed to be pumped to the landing collar.

The piston that unlocks the plug set from the running tool acts on a fluid filled chamber which is vented to the annulus through an orifice. When the pump down plug is sealed within the bore of the liner wiper plug, increased fluid pressure acts on the piston. The type and volume of fluid vented, as well as the size of the orifice, determine the time it takes to move the piston to a plug release position. This time is important to allow the operator to determine the correct displacement of cement volumes for cementing the liner in the well.

The plug holder sub allows the running tool to be manipulated without any detrimental effects on the liner wiper plug. The pump down plug may be pumped at any desired speed to the liner wiper plug and sealed and latched. The hammering effect of landing the pump down plug on the liner wiper plug will not prematurely release the plug set. After the pump down plug has been seated and latched, the operator may increase pressure to the running tool, thereby confirming to the operator that the plug has been seated in the liner wiper plug. The operator may calculate the exact amount of displacement fluids it will take to cement the liner in the well. The fluid pressure may then be increased, causing the piston to start to move to the plug release position. The pump down plug and the liner wiper plug as a set will thus be released after a predetermined amount of time, which again is important to the operator being able to determine the correct displacement volumes for cementing the liner in the well.

It is an object of the present invention to provide a plug holder sub for releasing a liner wiper plug in response to high fluid pressure acting against a piston, which in turn expels fluid from a chamber through a metering jet.

It is a further object of the invention to provide an improved method of releasing a liner wiper plug in response to fluid pressure, such that fluid pressure moves a piston from a retaining position to a release position. The time it takes for high pressure to expel fluid through a metering jet is monitored to increase the reliability of properly releasing the liner wiper plug during the cementing operation.

It is a feature of the present invention that a C-shaped retainer member may be used for attaching the liner wiper plug to a tubular body, wherein movement of a piston to a release position releases the C-shaped retainer to release the liner wiper plug.

It is a further feature of the invention that the C-shaped ring may have threads or other internal gripping members for gripping engagement with the liner wiper plug. A metering jet may also have external threads for threaded engagement with the tubular body.

It is an advantage of the present invention that the plug holder sub is highly reliable and is relatively inexpensive.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
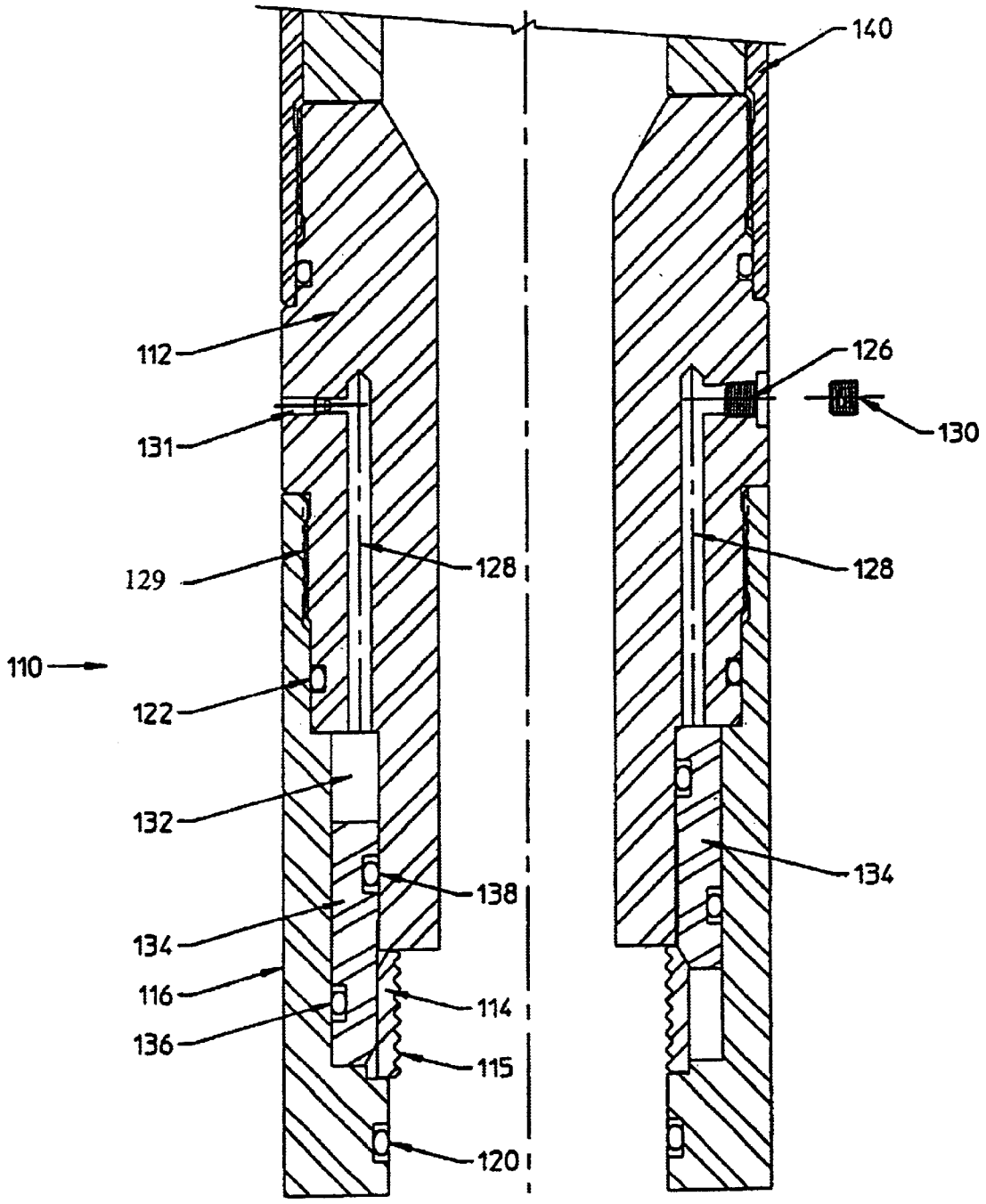
FIG. 1 is a cross-sectional view of a plug holder sub according to the present invention, illustrating the position of components for attachment to the liner wiper plug on the left side of the centerline and positioned for release of the liner wiper plug from the plug holder sub on the right side of the centerline.

FIG. 1 depicts a plug holder sub 110 for supporting a conventional liner wiper plug. The sub 110 includes the body 112 secured to the lower end of the running tool mandrel. Before the running tool and liner is lowered in the well, the liner wiper plug engages locking ring 114, which is supported between body 112 and the lower body 116 by piston 134. Locking ring 114 includes grooves or threads 115 or other suitable members for grippingly engaging the liner wiper plug. Seal 120 on the lower body 116 seals the plug holder sub to the liner wiper plug. Threads 129 connect the body 112 to lower body 116, and seal 122 seals between these connected bodies.

The body 112 includes a passageway 128 which is open to the annulus about the running tool. An orifice jet 130 with a relatively sized orifice is positioned along this port, and preferably includes threads for engagement with threaded port 126. Fluid containing chamber 132 is pressurized by the piston 134, which includes an OD seal 136 and an ID seal 138.

When the pump down plug lands within the liner wiper plug, the increased pressure within the running tool acts on the piston 134, which in turn is forced upward to expel fluid from the chamber 132. The rate fluid exits the chamber will be determined by the characteristics of the fluid within the chamber 132, and the size of a selected orifice in the jet 130 positioned downstream from the chamber. The left side view of FIG. 1 shows a pin 131 sealing off a weep port to the chamber 132. The pin 131 has a small port therein for slowly releasing pressurized fluid to the annulus. The pin 131 may be secured within the weep port by a swaging operation, and is another form of a metering jet. The right side illustrates a jet 130 for threading to the body 112.

A significant advantage of the plug holder sub according to the present invention is that the increase in fluid pressure is not the primary factor that determines the release of the plug set. The rate at which the piston moves up to expel fluid from the chamber is primarily a function of a particular jet size and the type of fluid in the chamber. Accordingly, the operator will see an increase in pressure when the pump down plug is landed on the liner wiper plug, and will then know, within selected limits, that a predetermined amount of time should elapse from that increase in pressure until the plug set is released. Once the piston 134 moves up to reduce or eliminate the volume within the chamber 132, the C-shaped locking ring 114 is free to move radially outward, thereby releasing the liner wiper plug and the pump down plug. The C-shaped locking ring 114 may be biased out but normally held radially in by the piston 134, or may be biased in and moved outward to release by the downward force on the liner wiper plug.

Plugs are conventionally run in a well in pairs, and the plug holder sub as shown in FIG. 1 is suited for supporting one pair of liner wiper plugs. In some applications, one pair of plugs are preferably used before the cement fluid, and another set of wiper plugs are used after the cement fluid and before the displacing fluid. For this latter application, each of the plug sets may be separately released in response to an increase in fluid pressure, which moves a respective piston to expel fluid from the chamber and thereby release the plug set. One piston responsive to a low pressure fluid could thus be provided on the support sub, with that piston releasing the first plug set. At a higher fluid pressure, a second piston may move in response to fluid pressure to release the second plug set. Each piston may force fluid through a selective orifice in a jet. If desired, the second piston and/or both first and second piston may be shear pinned so that no movement occurs until a selected pressure level is obtained. If desired, the first plug set alternatively could isolate the port for the second plug set so pressure could not act on the second plug set till the first plug set was released.

Figure 2:
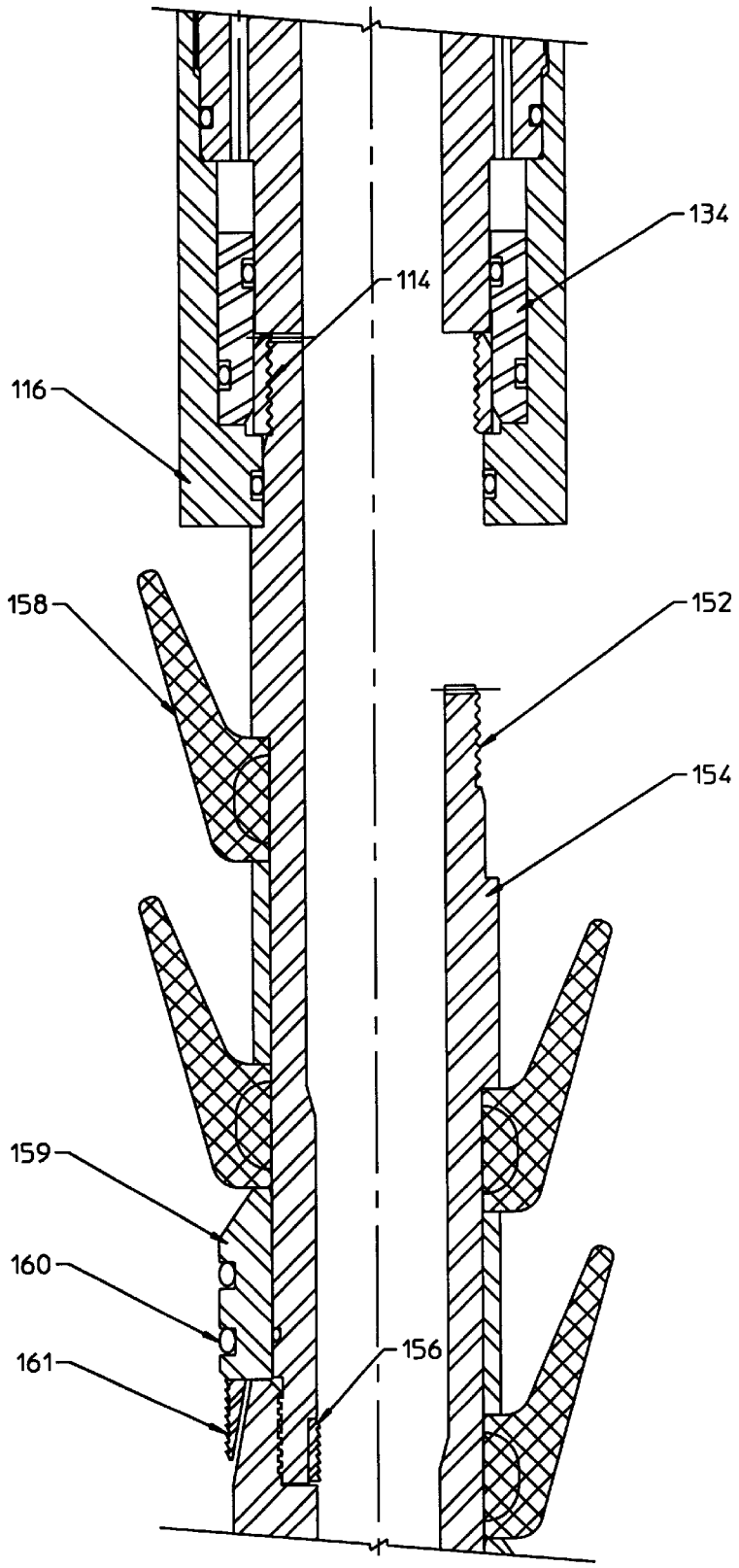
FIG. 2 is a cross-sectional view of a lower portion of plug holder sub shown in FIG. 1, illustrating the upper portion of a liner wiper plug attached to the plug holder sub on the left side of the centerline, and released on the right side of the centerline.

FIG. 2 depicts the piston 134 in its retaining position, with the C-shaped retaining member 114 held radially inward so that its threads engage the mating threads 152 on the liner wiper plug 154. The through passageway in liner wiper plug 154 is provided with a seat 156 for sealing with a conventional pump down plug, as discussed above. The liner wiper plug 154 conventionally includes at least one and preferably two cup shaped elastomeric sealing members 158 on an exterior thereof so that high fluid pressure behind the liner wiper plug forces the liner wipers outward into sealing engagement with the liner. An annular body 159 with o-rings 160 and latch ring 161 may be provided for sealing and latching the plug set with the landing collar.

The spacer and cement fluids may be mixed while circulating fluids for cement displacement. When the cement has been pumped, the pump down plug may be released from the surface, forming a barrier between the previously displaced cement and the displacement fluid. A calculated amount of displacement fluid may thus be used to pump the pump down plug to the liner wiper plug. As the pump down plug get close to the running tool, fluid pressure may be reduced, e.g. to about 500 psi, and this pressure will increase when the pump down plug lands in the liner wiper plug, as discussed above.

Once the pump down plug is latched into the liner wiper plug, the work string can be pressured up and after a selected period of time, the liner wiper plug and the pump down plug will be released from the plug holder sub. Increased fluid pressure thus moves a piston to release a lock ring, which releases the liner wiper plug from the plug holder sub.

The piston within the plug holder sub preferably acts on a fluid with a known viscosity at the downhole temperature of the plug holder sub. Fluid flow through a predetermined size orifice will take a predetermined period of time to release the liner wiper plug. This time may be used by the operator to positively calculate displacement fluid volumes. A calculated amount of displacement fluid will thus force the cement to the desired height in the annulus between the liner and the casing. Fluid will thus be pumped until the liner wiper plug and the pump down plug set latches into the landing collar, at which time pressure may be increased to, e.g. 1000 psi, over circulating pressure to complete latching of plugs and check that the seals between the plugs and the landing collar are holding. Pressure may then be bleed off and checked for bleed back to ensure that the float equipment is holding pressure.

Various types of metering jets may be used for selectively metering fluid from the chamber 132. Significant restrictions can be formed within the passageway 128 to effectively constitute a metering jet. Fluid in the chamber 132 will be at a known viscosity for the downhole conditions, and with a selectively size metering jet the operator will know with reasonable accuracy the time it will take for the piston 134 to move from the retaining position to the release position.

Other forms of retainer members may be used for interconnecting the tubular body 116 with the liner wiper plug. A preferred retainer member has a C-shaped configuration with internal grooves or teeth for attaching to the liner wiper plug. The internal surface of the piston 134 thus prevents the retainer member from moving to the released position until the piston moves axially to its release position, as shown on the right side of FIG. 1.

As discussed above, the liner wiper plug may be used at the lower end of the liner hanger running tool. The plug holder sub of the present invention may be used more generally at the lower end of any conveyance tubular, such as conveyance tubular 140 as generally shown in FIG. 1. The conveyance tubular 140 may thus be used to both transmit fluid pressure to the interior of the plug holder sub, and also to position the plug holder sub at a selected location within the well. The plug holder sub of the present invention may thus be used at the lower end of various types of tools, including a liner hanger running tool, or at the lower end of the tubular string used in a cementing operation, in order to reliably release the wiper plug from the plug holder sub during the cementing operation. The wiper plug once released may seal with the liner or with another downhole tubular.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. A plug holder sub for being supported on a conveyance tubular for temporarily supporting a wiper plug and for releasing the wiper plug in response to an increase in fluid pressure within the conveyance tubular, the plug holder sub comprising:

a generally tubular body adapted for connection with the conveyance tubular and having a throughbore in fluid communication with the conveyance tubular;

a retainer member for attaching the wiper plug to the tubular body, the retainer member movable from a retaining position to a release position for releasing the wiper plug from the tubular body;

a piston movable within the tubular body in response to fluid pressure within the throughbore from a retaining position for preventing the releasing member from moving to the release position, the piston acting against a fluid within a chamber within the tubular body when moving to the release position; and a metering jet along a fluid flow path from the fluid chamber to an annulus about the tubular body, such that fluid pressure within the throughbore restrains movement of the piston to the release position until fluid is forced through the metering jet, thereby preventing release of the liner wiper plug until the piston moves to the release position.

2. The plug holder as defined in claim 1, wherein the wiper plug includes an internal seat, such that a pump down plug landed on the wiper plug allows for the increase in fluid pressure within the tubular body.

3. The plug holder as defined in claim 1, wherein the retainer member is a C-shape ring which is radially expanded when the piston is in the release position to release the wiper plug.

4. The plug holder as defined in claim 1, wherein the C-shaped ring has internal gripping members for gripping engagement with the wiper plug.

5. The plug holder sub as defined in claim 1, wherein the piston moves axially from the retaining position to the release position.

6. The plug holder sub as defined in claim 5, wherein a radially interior surface of the piston engages the retainer member to prevent the retainer member from moving to the release position, and axial movement of the piston releases the retainer member to the release position.

7. The plug holder sub as defined in claim 1, where the metering jet has external threads for threaded engagement with the tubular body.

8. The plug holder sub as defined in claim 1, wherein the metering jet is secured to the tubular body by a swage connection.

9. A plug holder sub for being supported on a conveyance tubular for temporarily supporting a wiper plug and for releasing the wiper plug in response to an increase in fluid pressure within the conveyance tubular, the plug holder sub comprising:

a generally tubular body adapted for connection with the conveyance tubular and having a throughbore in fluid communication with the conveyance tubular;

a retainer member for attaching the liner wiper plug to the tubular body, the retainer member movable from a retaining position to a release position for releasing the wiper plug from the tubular body;

a piston axially movable within the tubular body in response to fluid pressure within the throughbore for preventing the retainer member from moving to the release position, a radially interior surface of the piston engaging the retainer member to prevent the retainer member from moving to the release position, and axial movement of the piston releases the retainer member to the release position, the piston acting against a fluid within a chamber within the tubular body when moving to the release position; and a metering jet along a fluid flow path from the fluid chamber to an annulus about the tubular body, such the fluid pressure within the throughbore restrains movement of the piston to the release position until fluid is forced through the metering jet, thereby preventing release of the wiper plug until the piston moves to the release position.

10. The plug holder sub as defined in claim 9, wherein the plug holder sub is positioned on a lower end of a liner hanger running tool, and the wiper plug is a liner wiper plug.

11. The plug holder as defined in claim 10, wherein the liner wiper plug includes an internal seat, such that a pump down plug landed on the liner wiper plug allows for the increase in fluid pressure within the tubular body.

12. The plug holder sub as defined in claim 9, wherein the fluid in the chamber has a known viscosity.

13. The plug holder as defined in claim 9, herein the retainer member is a C-shaped ring which is radially expanded when the piston is in the release position to release the wiper plug, and the C-shaped ring has internal gripping members for gripping engagement with the wiper plug.

14. A method of supporting a liner wiper plug on a conveyance tubular and for releasing the liner wiper plug in response to an increase in fluid pressure within the conveyance tubular, the method comprising:

providing a generally tubular body adapted for connection with the conveyance tubular and having a throughbore in fluid communication with the conveyance tubular;

providing a retainer member for attaching the liner wiper plug to the tubular body, the retainer member movable from a retaining position to a release position for releasing the liner wiper plug from the tubular body;

moving a piston within the tubular body in response to fluid pressure within the throughbore for preventing the retainer member from moving to the release position, the piston acting against a fluid within a chamber within the tubular body when moving to the release position;

metering discharge of fluid along a fluid flow path from the fluid chamber to an annulus about the tubular body, such that fluid pressure within the throughbore restrains movement of the piston to the release position until fluid is forced through a metering jet, thereby preventing release of the liner wiper plug until the piston moves to the release position;

allowing the retainer member to move to the release position when the piston is in the release position, thereby releasing the liner wiper plug from the tubular body; and monitoring a drop in fluid pressure in response to the release of the liner wiper plug.

15. The method as defined in claim 14, wherein the retainer member includes providing a C-shaped ring which is radially expanded when the piston is in the release position to release the liner wiper plug.

16. The method as defined in claim 15, further comprising:

providing internal gripping members on the C-shaped ring for gripping engagement with the liner wiper plug.

17. The method as defined in claim 14, wherein the piston moves axially from the retaining position to the release position.

18. The method as defined in claim 14, wherein the piston moves axially from the retaining position to the release position.

19. The method as defined in claim 18, wherein a radially interior surface of the piston engages the retainer member to prevent the retainer member from moving to the release position, and axial movement of the piston releases the retainer member to the release position.

20. The method as defined in claim 14, further comprising:

providing an internal seat on the liner wiper plug, such that a pump down plug landed on the liner wiper plug allows for the increase in fluid pressure within the tubular body.

21. A liner hanger running tool for running the liner into a well from a running string, the liner hanger running tool including a plug holder sub to support a liner wiper plug on the running tool, such that a pump down plug lands on the liner wiper plug to substantially limit flow through the running tool, the running tool further comprising:

the plug holder sub being secured to a running tool mandrel;

a fluid filled chamber within the plug holder sub, such that the chamber is vented to outside the plug holder sub through a restricted orifice;

a fluid pressure responsive piston moveable within the chamber relative to the plug holder sub from a locked position wherein the liner wiper plug is supported from the plug holder sub to a release position wherein the liner wiper plug is released from the plug holder sub; and a radially expandable lock ring for gripping engagement with the liner wiper plug, such that radially outward movement of the lock ring in response to movement of the piston releases the liner wiper plug from the plug holder sub.

22. A liner hanger running tool as defined in claim 21, wherein the plug holder sub is positioned axially at a lower end of the running tool.

23. A liner hanger running tool as defined in claim 21, wherein the fluid filled chamber is vented to an annulus surrounding the sub holder sub.

24. A running tool as defined in claim 21, wherein the plug holder sub includes a seal for sealing engagement between the plug holder sub and the liner wiper plug.

25. A method of releasing a liner wiper plug supported on a running tool for running a liner into a well from a running string, the method comprising:

providing a fluid filled chamber within a plug holder sub vented to outside the plug holder sub through an orifice; and moving a piston in response to fluid pressure within the running string, such that piston movement is from a locked position wherein a C-ring supports the liner wiper plug to a release position wherein the liner wiper plug is released from the plug holder sub.

26. A method as defined in claim 25, further comprising:

timing a period between fluid pressure applied to the piston and a drop in fluid pressure accompanying the release of the liner wiper plug to verify release of the liner wiper plug.

* * * * *